United States Patent [19]

Scatena

[11] Patent Number: 4,715,130

[45] Date of Patent: Dec. 29, 1987

[54] CUSHION SYSTEM FOR SHOES

[76] Inventor: Alessandro Scatena, P.O. Box 11, 55060 Guamo, Lucca, Italy

[21] Appl. No.: 881,086

[22] Filed: Jul. 2, 1986

[30] Foreign Application Priority Data

Sep. 20, 1985 [IT] Italy ..... 87710 A/85

[51] Int. Cl.[4] ..... A43B 21/30; A43B 21/26

[52] U.S. Cl. ..... 36/27; 36/38; 36/28

[58] Field of Search ..... 36/38, 37, 36 R, 35 R, 36/28, 7.8, 27

[56] References Cited

U.S. PATENT DOCUMENTS

| | | | |
|---|---|---|---|
| 1,670,747 | 5/1928 | Sestito | 36/38 |
| 2,437,227 | 3/1948 | Hall | 36/28 |
| 2,710,460 | 6/1955 | Stasinos | 36/8.5 |
| 2,721,400 | 10/1955 | Israel | 36/8.5 |
| 3,996,677 | 12/1976 | Reina | 36/7.8 |
| 4,267,648 | 5/1981 | Weisz | 36/38 |
| 4,296,557 | 10/1981 | Pajeuc | 36/7.8 |

FOREIGN PATENT DOCUMENTS

| | | | |
|---|---|---|---|
| 203631 | 10/1908 | Fed. Rep. of Germany | 36/7.8 |
| 1485654 | 3/1970 | Fed. Rep. of Germany | 36/28 |
| 871303 | 4/1942 | France . | |
| 2577119 | 4/1986 | France . | |
| 31816 | 11/1952 | Luxembourg . | |
| 14367 | 10/1890 | United Kingdom | 36/28 |

*Primary Examiner*—Werner H. Schroeder
*Assistant Examiner*—Steven N. Meyers
*Attorney, Agent, or Firm*—Bucknam and Archer

[57] ABSTRACT

The cushioning assembly for the shoe is located in the rear part and comprises at least one spring positioned between the outer sole and the shoe upper, the shoe comprising an intersole positioned between the outer sole and the upper. The outer sole has at least one internally threaded orifice and at least one pin is provided with an externally threaded portion, the externally threaded portion being engageable with the threaded orifice of the outer sole. The intersole has at least one threaded orifice of same size as the orifice and the spring rests on the threaded portion of the pin. The upper member has at least one tooth, the tooth entering the upper part of the spring, whereby the spring is held in place. Preferably a plurality of pins and springs and a plurality of teeth are provided and the springs may also be held in place between one tooth and the adjacent tooth.

6 Claims, 8 Drawing Figures

CUSHION SYSTEM FOR SHOES

FIELD OF THE INVENTION

This invention relates to shoes and more specifically to shoes which are provided with a cushioning assembly in the rear part. The cushioned shoe according to the present invention exerts a shock absorbing action when the wearer is in motion and also when he is standing. The cushioning system also helps to give the foot the correct position.

DESCRIPTION OF THE RELATED ART

The present invention differs from other known devices which are mainly based on a different type of material being inserted between the shoe upper and the outer sole, or the presence of dampening inserts made of plastic material which are placed laterally or which pass through the rear part of the sole.

SUMMARY OF THE INVENTION

The crux of the present invention resides in the insertion of at least one, preferably a plurality of pins provided with springs in the rear portion of the shoe between the outer sole of the shoe which comes in contact with the ground and the upper. The invention is further illustrated by reference to the accompanying drawings of which:

FIG. 1 is an elevational view in of the pin and spring;

FIG. 1*a* is an elevational view partially in cross-section of the pin with a part sectional view according to line B—B in FIG. 1*b*.

FIG. 1*b* is a plan view of the pin, in section, along line a—a in FIG. 1*a*.

Figure 2:
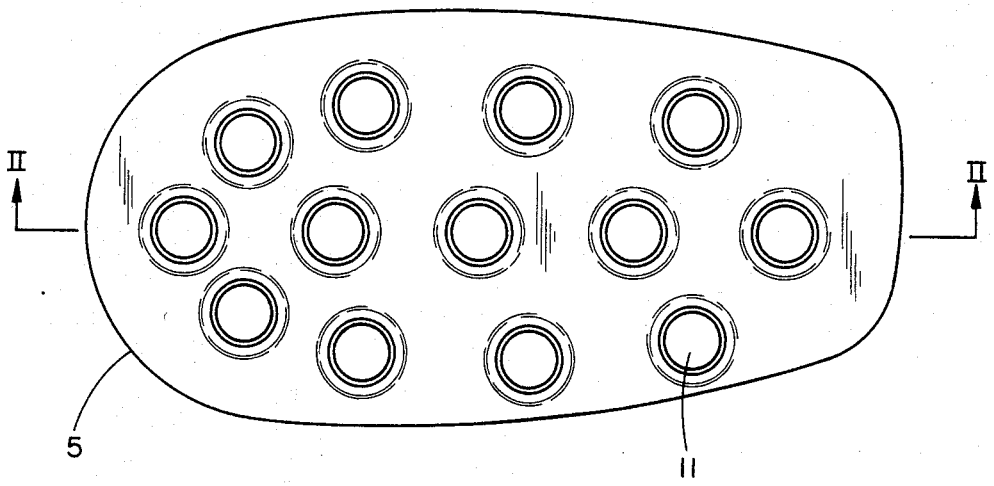
FIG. 2 is a plan view of the intersole.
Figure 3:
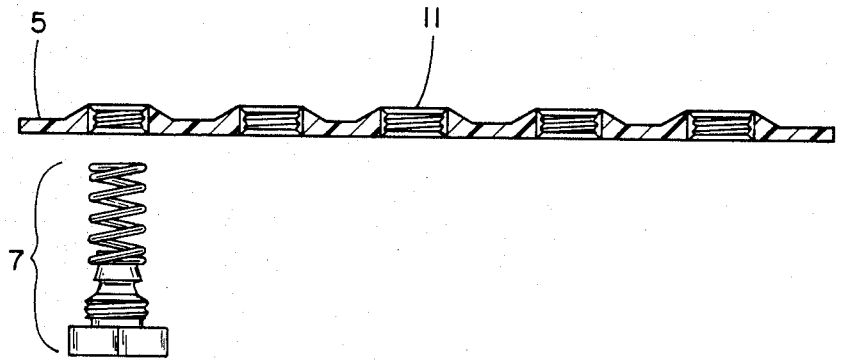
FIG. 3 is a view of the intersole in cross-section according to line II—II in FIG. 2, showing the pin and spring to be inserted through an orifice of the intersole.

By reference to the drawings, FIG. 2, the intersole 5 is made of plastic or metal and is about 0.3–0.8 cm. It is provided with a plurality of threaded orifices 11 in which the pins are introduced.

Figure 6:
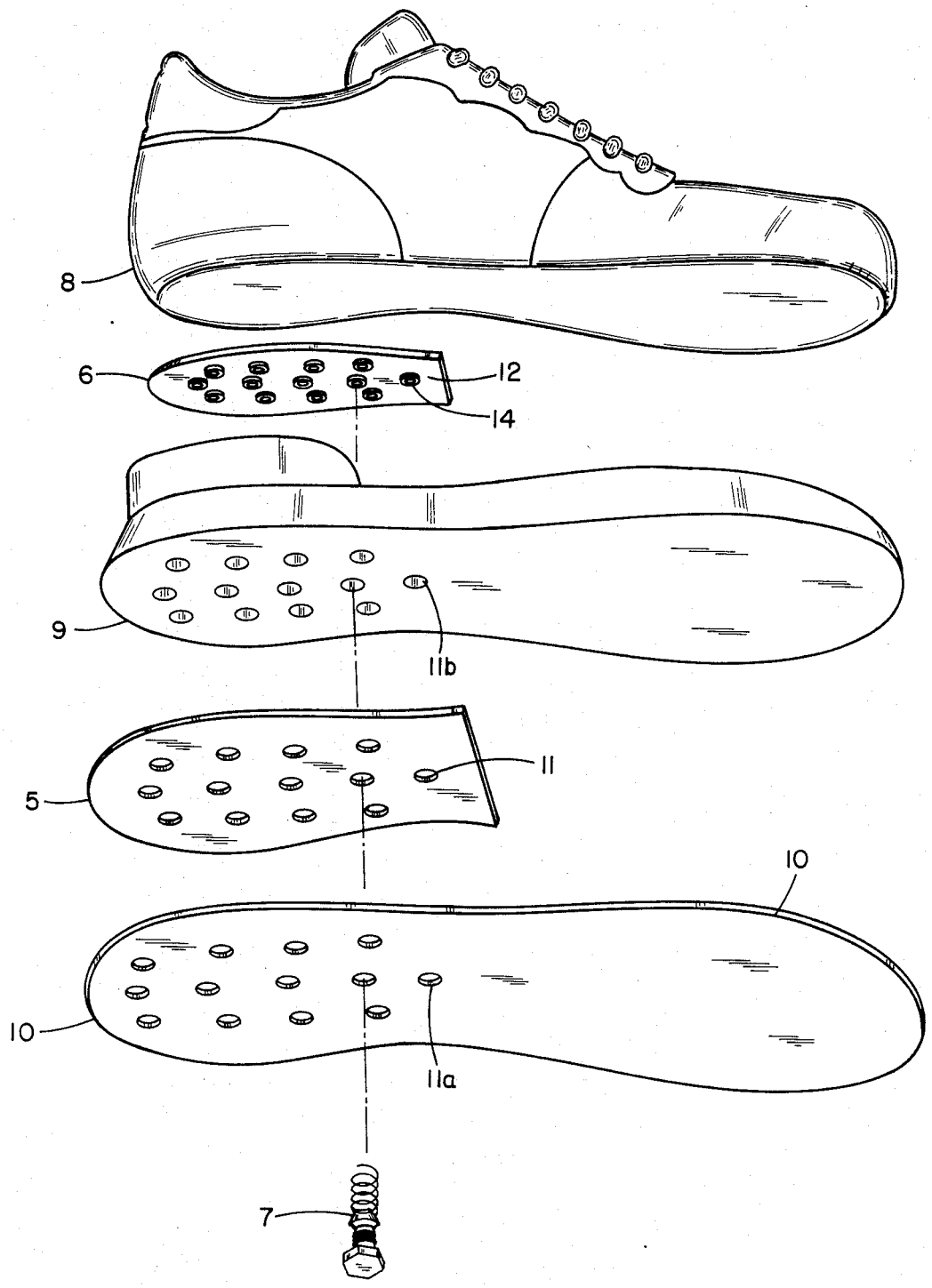
FIG. 6 is an exploded view of the arrangement of the different parts of the cushioning assembly.

Numeral 10 in FIG. 6 illustrates the outer sole which is intended to come in contact with the ground. It is provided with a plurality of threaded orifices 11*a* in locations corresponding to the orifices 11 in the intersole. Numeral 12 is the upper part of the sole which comes in contact with the foot.

Figure 1:
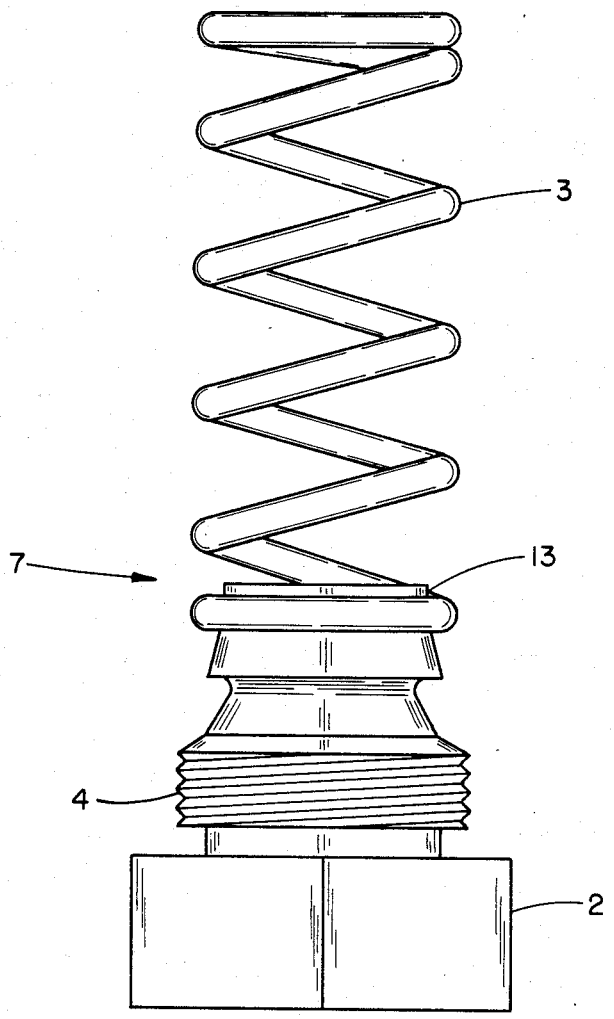
Figure 1A:
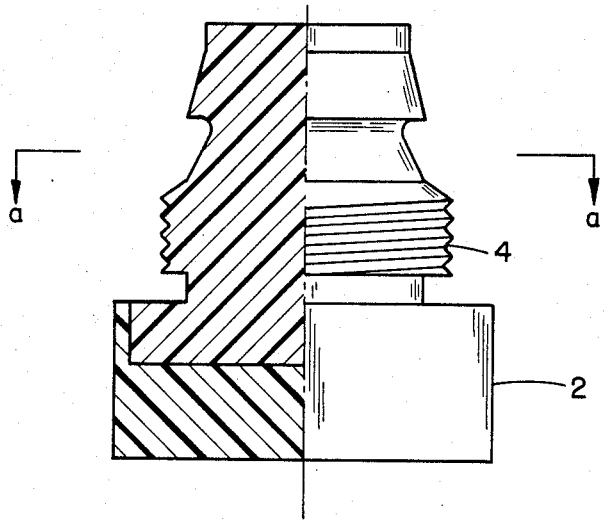
Figure 1B:
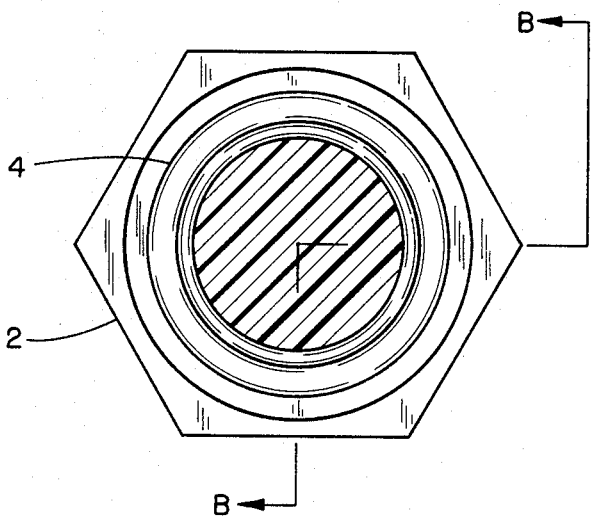

By reference to FIG. 1, the pin comprises a bottom portion 2 made of hard thermoplastic or rubber material and an upper portion 4 which is externally threaded. A spring 3 is placed firmly on the top portion 13 of the pin. The pin serves three functions, namely it is a support for the spring, it is provided with a hard portion which comes in contact with the ground and is threaded to permit engagement with the intersole. The assembly of the pin and spring is designated by numeral 7.

As shown in FIG. 2, numeral 5 is the intersole provided with threaded orifices 11. This intersole is made of plastic material or metal. This intersole serves the function of housing the pin, imparting alignment to the spring, and imparting strength to the zone where the cushioning action is being exerted. Further it offsets any sliding of the cushioning assembly.

Figure 4:
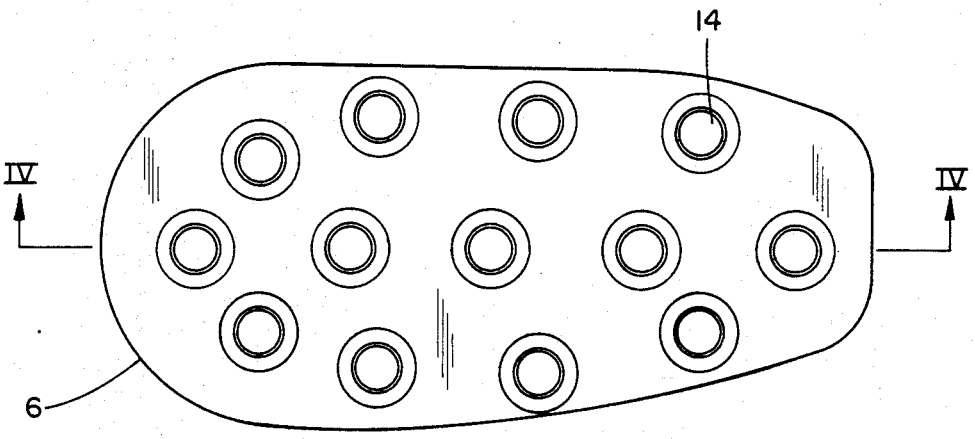
FIG. 4 is a plan view of the upper sole of the cushioning assembly.
Figure 5:
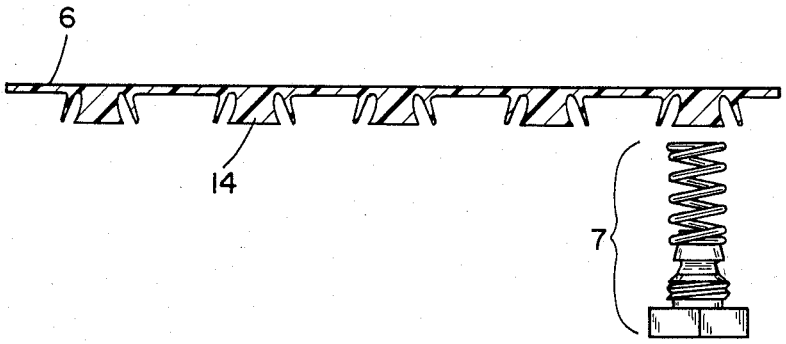
FIG. 5 is a cross section of the upper sole according to line IV—IV in FIG. 4, showing the pin and spring associated with one of the teeth of the upper sole.

FIG. 4 illustrates the upper sole 6 provided with a plurality of projections or teeth 14. The latter enter within the top part of the springs after the shoe is assembled so that the springs are firmly held in place. This upper sole 6 in addition to holding the springs and preventing the springs from hurting the foot of the wearer, impart strenth to the cushioning zone and counterbalance the sliding of the cushioning assembly.

Numeral 10 in FIG. 6 is a conventional sole of a shoe provided with orifices 11*a*. These orifices are of size essentially equal to the base 2 of the pin.

Numeral 9 in FIG. 6 is another intersole which may optionally be inserted under the upper sole 6. This intersole is preferably made of foamed material, of low density so that it creates no resistance and contributes to create a shock absorbing action. It is provided with orifices 11*b* which must be of same size as the orifices 11 and are located in positions corresponding to orifices 11 and 11*a*. The spring 3 may be made of different material so that it will have different strength. The intersole 5 may be glued, sewn or may be attached to the outer sole by any suitable means. This intersole 5 gives the spring the correct direction and angle of inclination, reinforces the cushioning zone and through an appropriate angle of inclination inwardly, it balances the slight slipping or sliding outwardly of the assembly. This intersole may be made of metallic or plastic material or may be rigid, may be made of one piece or composed of multiple parts.

Upper sole 6 provided with teeth may be glued, sewn, or fixed by any appropriate means to the shoe upper. It holds the upper ends of the springs, which may also be pressed against the toothed surface, thus avoiding skidding during use. It also reinforces the cushioning zone and counterbalances the skidding of the system by strengthening the material in the outer part of the foot, and provides a slight amount of inclination inwardly.

The diameter of the orifices may vary according to shoe size. It is not necessary to provide a specially designed system for the various sizes or half-sizes but lower pre-punched intersoles or toothed upper soles may be utilized for various sizes. The number or orifices as well as the dimensions and strength of the springs, are determined by the weight to be supported, or by the orthopedic defect to be corrected. The number of the orifices in the illustrateed example is 13 which is suitable for average-sized shoes. Smaller sizes have less holes, while larger sizes have a greater number.

The total cushioning force resulting from the assembly according to the present invention is the sum of the number of springs multiplied by the elastic modulus of each spring and the elastic modulus of the outer sole. FIG. 6 shows how the different parts are arranged. The pins may be screwed in place by means of a suitable screwdriver. The base of the pin may be circular or any other shape, for instance hexagonal. When the pins are worn out, they may be simply replaced in place.

One advantage of the shoe according to the present invention is that it may be used for sports footwear, such as training, jogging, tennis and foot-ball shoes, or any other shoe specifically used for running or marching. Due to its shock-absorbing effect, it minimizes the consequences of ailments such as tendonitis, periostitis, or any other temporary or chornic disease. Also the number of springs and the position of the springs may be varied according to individual needs. The cushioned shoe according to the invention reduces fatigue, reduces muscular strain and protects the bones of the foot.

What is claimed is:

1. A cushioning assembly for the rear part of a shoe comprising an outer sole (10), an upper sole (6), a first intersole (5) positioned adjacent said outer sole, at least one spring (3) positioned between said outer sole (10) and said upper sole (6), said spring having a top part and a lower part, said upper sole having at least one tooth (14), said tooth entering the top part of said spring and supporting said top part and holding the spring in place, said first intersole (5) having at least one threaded orifice (11), a pin (1) having a rigid base (2), an externally threaded portion (4), said threaded portion of said pin (4) being engageable with said threaded orifice (11) of said first intersole, said outer sole (10) having at least orifice (11a) in alignment with said threaded orifice of said intersole, said externally threaded portion of said pin passing through said orifice of said outer sole (10), said orifice of said outer sole being of size essentially equal to said base (2) of said pin, the bottom part of said spring resting on said pin.

2. The cushioning assembly according to claim 1 wherein said base (2) of the pin is a stud integral with said threaded portion of the pin.

3. The cushioning assembly according to claim 1 which has a plurality of springs, said outer sole (10) has a plurality of orificies, said first intersole has a plurality of threaded orifices, said upper sole has a plurality of teeth, each of said teeth entering the upper part of each of said springs and holding said spring in place.

4. The cushioning assembly according to claim 1, wherein said intersole (5) is amde of plastic material or a metal.

5. The cushioning assembly according to claim 1, which comprises a second intersole (9) placed between said first intersole (5) and said upper sole (6), said second intersole (9) being made of foamed, elastically deformable material and being provided with orifices (11*b*) in alignment with the orifices (11) of said first intersole and the orifices of said outer sole.

6. The cushioning assembly according to claim 1, wherein the pin (1) has a top portion (13) supporting the lower part of said spring (3).

* * * * *